US005388639A

United States Patent [19]

Betchan et al.

[11] Patent Number: 5,388,639

[45] Date of Patent: Feb. 14, 1995

[54] WELLHEAD TUBING ROTATOR

[76] Inventors: Stanley G. Betchan, 716 Palmer; Stanley E. Betchan, 1801 Yokley, both of Rockdale, Tex. 76567

[21] Appl. No.: 169,395

[22] Filed: Dec. 20, 1993

[51] Int. Cl.[6] ..... E21B 19/00; E21B 33/03

[52] U.S. Cl. ..... 166/78; 166/85; 166/379

[58] Field of Search ..... 166/78, 75.1, 85, 379, 166/380

[56] References Cited

U.S. PATENT DOCUMENTS

| | | | |
|---|---|---|---|
| 1,650,102 | 11/1927 | Tschappat | 166/78 |
| 2,294,061 | 8/1942 | Williamson | 166/78 |
| 2,471,198 | 5/1949 | Cormany | 166/78 |
| 2,595,434 | 5/1952 | Williams | 166/78 |
| 2,599,039 | 6/1952 | Baker | 166/78 |

FOREIGN PATENT DOCUMENTS

| | | |
|---|---|---|
| 1131617 | 6/1962 | Germany . |
| 959749 | 6/1964 | United Kingdom . |

*Primary Examiner*—Stephen J. Novosad
*Attorney, Agent, or Firm*—Richard C. Litman

[57] ABSTRACT

An assembly for insertion in line into a pipestring of an oil well, for enabling manual rotation of the pipestring by one person. The assembly sits atop an existing well head, and is clamped thereto by a hammer nut. The assembly comprises a generally cylindrical housing having an internal shoulder and an external flange. Nested within the housing are, respectively, a bottom plate, a race and a bearing, a top plate, a resilient rubber washer, a rigid washer, and a threaded cap. These internal components all have a central opening through which passes a central section of tubing. This section of tubing is threaded at both ends, and extends beyond both ends of the cylindrical housing. The section of tubing has an external flange supported on the bearing, and supports the weight of a pipestring. The section of tubing threads above and below to existing threaded tubing. A handle clamps to the section of tubing above the housing, where it is accessible to oil field personnel, and the central tubing is rotated by this handle. The handle is folded down to engage projections formed in the cap, thus locking the pipestring at a selected position with respect to rotation. Rotation of the central tubing section rotates the attached pipestring. The cap can be tightly turned into the housing, so as to distend the resilient rubber washer, thus forming a seal against the housing and the central tubing section. Additional seals are provided about top and bottom plates, so that a supply of lubricant is retained by the bearing.

16 Claims, 3 Drawing Sheets

66
10
14
54
52
58
40
42
12
38
36
4
26
68
2

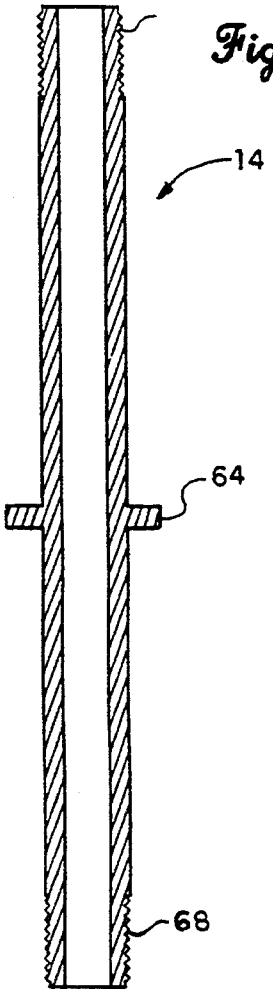
Fig. 3
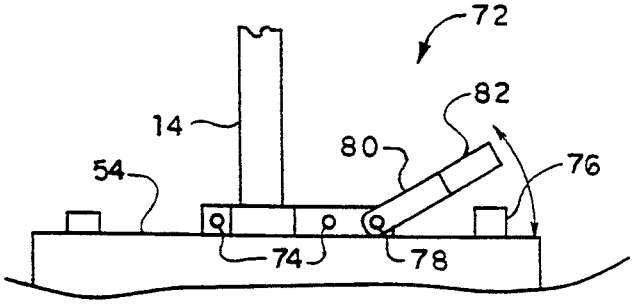
Fig. 5
Fig. 4
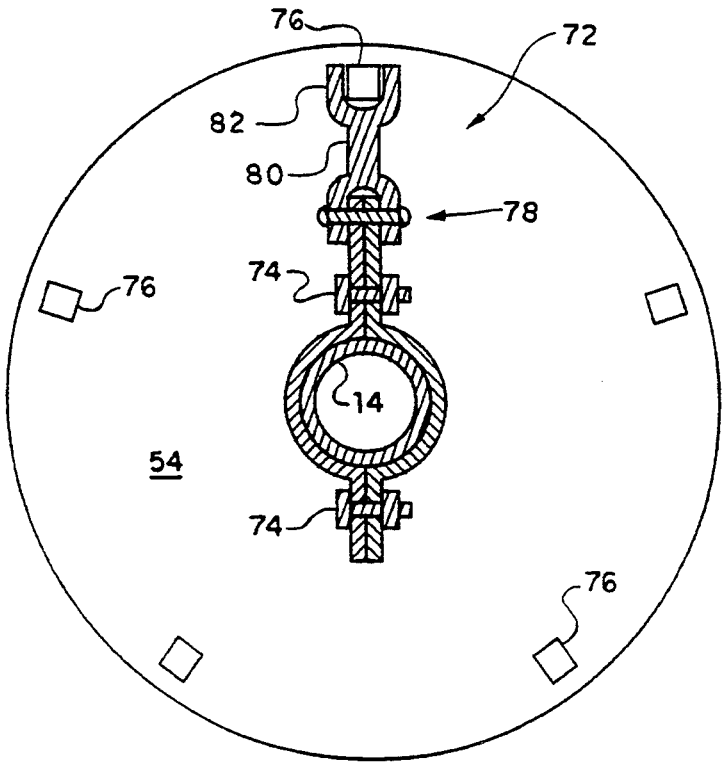

WELLHEAD TUBING ROTATOR

BACKGROUND OF THE INVENTION

1. Field of the Invention

The present invention relates to apparatus for rotating tubing or a pipestring after assembly of the latter within a wellhead.

2. Description of the Prior Art

Many oil wells are provided with pumps located deep underground, and power sources located above ground. Motion of the power source is transmitted to the pump by reciprocating rods, known in the industry as sucker rods, extending therebetween. Due to the great extent of these sucker rods, they can flex during a stroke, and rub against the inside of the tubing or pipestring in which they are enclosed. This contact will eventually result in localized wear of the pipestring.

The most economical approach to mitigating this problem appears to be rotating the pipestring, so that the contact is spread over a greater area of a portion of tubing. A given section of tubing thus survives far more wear prior to being destroyed thereby. Apparatus for rotating the pipestring of a well is known in the prior art.

U.S. Pat. No. 1,650,102, issued to Sheridan P. Tschappat on Nov. 22, 1927 and U.S. Pat. Nos. 2,599,039 and 2,693,238, issued to Jack F. Baker on Jun. 3, 1952 and Nov. 2, 1954, respectively, disclose devices for rotatably suspending a pipestring in a well. The devices of Baker '039 and '238 cap the well opening and incorporate an antifriction combination radial and thrust bearing. Openings are formed in a portion of the devices for accepting a lever or the like. The lever is used to rotate the devices and tubing attached to the same.

The device of Tschappat '102 also seals a well, having a rubber packing ring and a compression ring, and also has a thrust bearing. Rotation is accomplished by loosening a compression member and applying a wrench to a portion of the pipestring.

The hanger of Baker '039 is turned by inserting a rod or the like through a slot formed in a first member, into a recess formed in another member. One of these members rotates and the other is stationary, so that rotation is limited to an extent dictated by a point past which the recess and slot no longer align.

U.K. Pat. Document No. 959,749, dated Jun. 3, 1964, discloses a slip bowl, which shares certain structural and functional similarities to the housing of the present invention, although substantial differences will become evident upon reference to drawings and description of the latter included hereinafter.

U.S. Pat. No. 2,294,061, issued to Roy C. Williamson on Aug. 25, 1942, discloses a tubing rotating device having a split or two piece handle which is assembled and clamped around a tubing member.

German Patent Document No. 1,131,617, dated Jun. 20, 1962, discloses a ratcheting device for rotating tubing. Further examples of rotating devices are seen in U.S. Pat. Nos. 2,471,198 and 2,595,434, issued respectively to David R. Cormany on May 24, 1949 and to William W. Williams on May 6, 1952.

None of the above inventions and patents, taken either singly or in combination, is seen to describe the instant invention as claimed.

SUMMARY OF THE INVENTION

The present invention is directed to an uncomplicated assembly which can be installed in existing wells, and which cooperates with commonly provided equipment. Application of the invention will likely include low to medium production wells having a depth ranging between two or three thousand feet to seven or eight thousand feet. To this end, the novel wellhead tubing rotator comprises, firstly, a housing corresponding generally in size to conventional wellhead sealing assemblies, which readily threads thereto, and, secondly, a tubing extension which extends above and below the housing, which is rotatably held therein, and which threads to existing tubing. This tubing extension includes a flange enabling the pipestring to rest on a shoulder formed in the rotator. The housing is secured above an existing wellhead by a hammer nut threading to the existing wellhead, and sandwiching the novel wellhead tubing rotator therebetween.

The wellhead tubing rotator includes a folding handle enabling rotation to be performed manually by one person, and which can be locked in place at any one of several positions about a three hundred sixty degree turn. This enables periodic rotation to be performed and indicated to an observer without complicated additional structure.

The wellhead tubing rotator includes a chamber occupied by a bearing and a lubricant supply. The chamber is permanently sealed, with respect to assembly of the rotator, so that periodic lubrication is not required during the time the rotator is installed on a well. Additional seals are provided to contain natural pressure arising from fluids encountered within the well, such as gaseous hydrocarbons. The rotator includes a resilient member for adjusting tension imposed by a threaded cap.

Accordingly, it is a principal object of the invention to provide a wellhead tubing rotator which is readily installed on a well not originally provided therewith.

It is another object of the invention to provide a wellhead tubing rotator removably attachable to and supported by an existing wellhead.

It is a further object of the invention to provide a wellhead tubing rotator which includes a tubing member readily insertable in line to an existing pipestring.

Again a further object of the invention is to provide a wellhead tubing rotator which is manually operable by one person.

An additional object of the invention is to provide a wellhead tubing rotator which seals natural pressure within the well.

Still another object of the invention is to provide a wellhead tubing rotator which can be adjusted to exert a selectively variably tight seal retaining natural pressure within the well.

It is again an object of the invention to provide a wellhead tubing rotator including a permanently lubricated bearing.

Yet another object of the invention is to provide a wellhead tubing rotator having a tubing member insertable in line into a pipestring, and which tubing member includes structure for supporting a pipestring from the rotator.

Still a further object of the invention is to provide a wellhead tubing rotator which includes a permanently lubricated bearing for rotatably supporting a pipestring.

Yet another object of the invention is to provide a wellhead tubing rotator which indicates a relative rotated position thereof.

A still further object of the invention is to provide a wellhead tubing rotator which employs conventional tightening and attaching apparatus for assembly and disassembly thereof.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a side cross sectional detail view of a central tubing member of the invention.

FIG. 4 is a top plan, partly cross sectional detail view of the invention.

FIG. 5 is a side elevational detail view of the components shown in FIG. 4.

Similar reference characters denote corresponding features consistently throughout the attached drawings.

DETAILED DESCRIPTION OF THE PREFERRED EMBODIMENT

Figure 1:
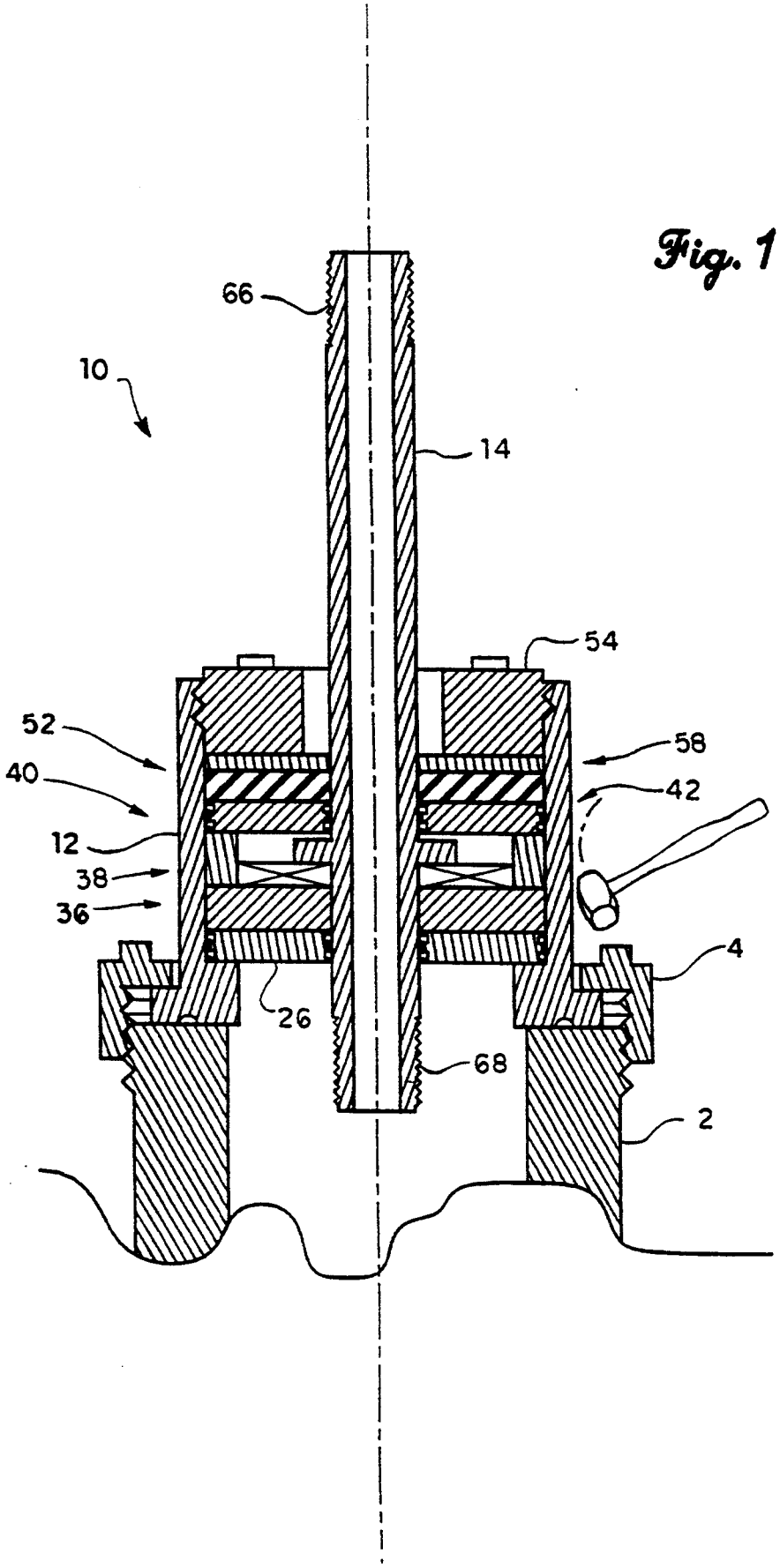
FIG. 1 is a partly diagrammatic, environmental, side cross sectional view of the invention.
Figure 2:
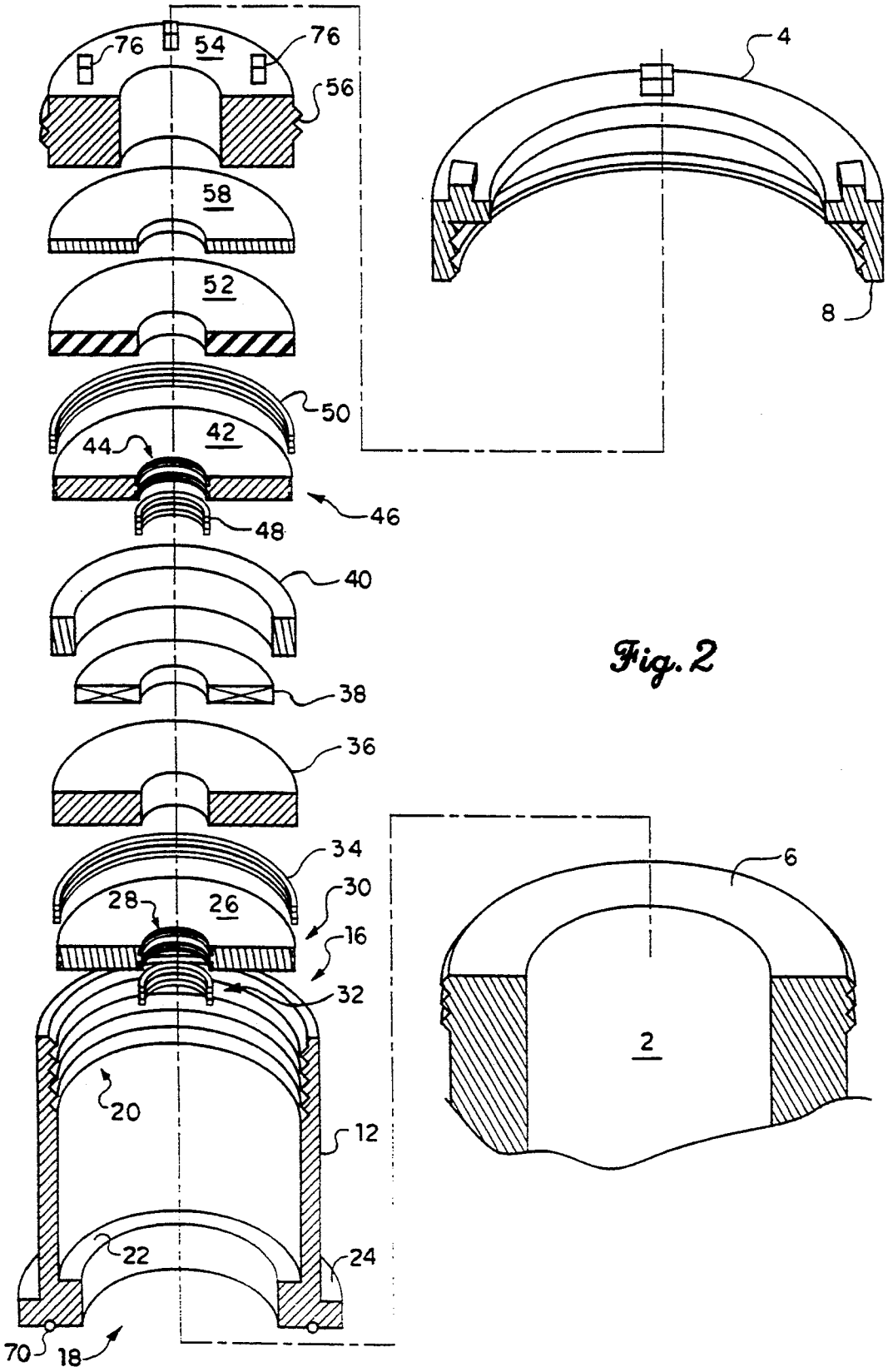
FIG. 2 is a diagrammatic, partly perspective, partly side cross sectional, exploded view of the invention.

Turning now to FIG. 1 of the drawings, the novel wellhead tubing rotator 10 is shown assembled to a wellhead 2, and retained thereto by a conventional hammer nut 4. Rotator 10 comprises a housing 12 through which passes a central tubing member 14, and other internal components which are better understood with reference to FIG. 2.

Housing 12 is seen to have generally cylindrical configuration defined by an annular main wall. Housing 12 includes a top opening 16 and a bottom opening 18. Located at top opening 16 are internal threads 20. Toward bottom opening 18 are an interior shoulder 22 and an external flange 24. External flange 24 is clamped between the top surface 6 of wellhead 2 and a downwardly facing surface 8 of hammer nut 4.

Within housing 12 is a bottom plate 26 which, when assembled, rests on internal shoulder 22. Bottom plate 26 has grooves 28 and 30 for accommodating sealing rings 32 and 34. A bearing race 36 is supported by bottom plate 26. Bearing 38 rides on race 36, and is surrounded by a spacer 40, the purpose of which will be explained hereinafter.

A top plate 42 is located above bearing 38 and spacer 40, and includes respective grooves 44 and 46, for accommodating respective sealing rings 48 and 50. A resilient seal 52 is located above top plate 42, providing a secondary degree of sealing complementing sealing provided by sealing rings 32,34,48,50. A cap 54 having threads 56 cooperating with threads 20 can be screwed into housing 12, thus compressing resilient seal 52. Depending upon pressure bearing on cap 54, resilient seal 52 distends, and contacts housing 12 at selectively variable pressure. A washer 58 separates resilient seal 52 from cap 54, thus protecting resilient seal 52 from abrasion arising from rotation of cap 54.

Spacer 40 surrounds bearing 38, in order to oppose compressive force exerted by cap 54, when being threaded into housing 12, from acting on bearing 38.

Central tubing member 14 is rotatably held within housing 12 by the following arrangement. As more clearly seen in the detail of FIG. 3, central tubing member 14 includes an external flange 64. This flange 64 rests on bearing 38, and is supported thereby.

Again referring to FIG. 1, bottom plate 26, bearing race 36, spacer 40, top plate 42, resilient seal 52, washer 58, and spacer 40 each have a central opening therein through which central tubing member 14 passes.

Central tubing member 14 includes top and bottom threads 66,68 which are configured to mate with threads of the pipestring (not shown). In this manner, rotator 10 is inserted in line within the pipestring. Mutual engagement of threads 66 and 68 with respective threads formed in the pipestring is sufficient to rotate the latter when rotator 10 is operated.

In the preferred embodiment, central tubing member 14 extends through and beyond both ends of housing 12. This enables ready manipulation and interengagement of central tubing member 14 and the existing pipestring.

Sealing rings 32,34,48,50 perform two functions. The first is that they retain pressure from below rotator 10 in the well casing (not shown). A second function is that they seal bearing 38 so that when assembled, a lubricant such as oil is poured over bearing 38, and is captively retained. Bearing 38 is thus permanently lubricated, with respect to the time period during which rotator 10 is assembled to the pipestring (not shown).

Leakage of pressure from the well between housing 12 and wellhead 2 is prevented by an O-ring 70 held captively within housing 12.

Referring now to FIG. 4, a handle 72 is provided. Handle 72 surrounds and clamps to central tubing member 14, situated above housing 12 and cap 54 for ready access. Handle 72 is formed from complementary parts which are assembled around central tubing member 14. Securement is by bolts 74.

Cap 54 is seen to include upwardly extending projections 76. When cap 54 is securely threaded into housing 12, no respective rotation is possible. In this sense, projections 76 are immobile. Handle 72 incorporates a pivot joint 78, so that an outward portion 80 of handle 72 can be folded upwardly.

A yoke or socket 82 is formed at the end of outward portion 80, which socket 82 aligns radially with projections 76. When folded down, as illustrated in FIG. 4, handle 72 engages one projection 76, and rotator 10 is prevented from rotating with respect to the sucker rods (not shown).

Rotation of the pipestring is performed by raising outer portion 80 of handle 72 out of engagement with an engaged projection 76, as seen in FIG. 5, and manually turning handle 72 about the pipestring axis.

Preferably, rotation is to a limited degree, such as from one projection to the next. Handle 72 can thus be employed in the capacity of an indicator, enabling a subsequent rotation operation to be performed some weeks or months later. Oil field personnel need merely move handle 72 to succeeding positions, confident that the current position has not moved.

It is to be understood that the present invention is not limited to the sole embodiment described above, but encompasses any and all embodiments within the scope of the following claims.

We claim:

1. A wellhead tubing rotator, comprising:

a generally cylindrical housing having an annular main wall having a first external flange, and defining at one end an interior shoulder, and defining at the other end threads;

a bearing supported within said housing and above said interior shoulder;

a cap having threads cooperating with said housing threads, whereby said cap is installed in said housing by threading thereto;

a central tubing section rotatably supported by said bearing;

a handle attachable to said central tubing section, whereby a person can grasp said handle and rotate said central tubing section; and a bottom plate defining a first central opening therein, said bottom plate disposed within said housing and below said bearing, said bottom plate supporting said bearing and partially surrounding said central tubing member.

2. The wellhead tubing rotator according to claim 1, further including a top plate disposed within said housing and above said bearing, said top plate having a second central opening therein and partially surrounding said central tubing member.

3. The wellhead tubing rotator according to claim 2, at least one of said bottom and top plates including a seal contacting said housing and retaining pressure therebelow.

4. The wellhead tubing rotator according to claim 2, at least one of said bottom and top plates including a seal contacting said central tubing member and retaining pressure therebelow.

5. The wellhead tubing rotator according to claim 2, further including a spacer disposed between said top plate and said bottom plate, said spacer opposing compressive force from acting on said bearing when said cap is threaded into said housing.

6. The wellhead tubing rotator according to claim 1, said central tubing section having a second external flange supported by said bearing.

7. The wellhead tubing rotator according to claim 1, there further being resilient seal means disposed beneath said cap, said resilient seal means distending under compression when said cap is turned into said housing, thereby contacting said housing at selectively variable pressure.

8. The wellhead tubing rotator according to claim 7, further including a washer disposed between said resilient seal means and said cap, for protecting said resilient seal means from abrasion by rotation of said cap.

9. The wellhead tubing rotator according to claim 1, said central tubing member extending through and beyond said housing at both ends of said housing.

10. The wellhead tubing rotator according to claim 1, said handle comprising complementary parts assembled around and clamping said central tubing section.

11. The wellhead tubing rotator according to claim 1, said cap further comprising a plurality of immobile projections extending upwardly therefrom, and said handle including member engageable with said immobile projections, whereby said wellhead tubing rotator can be prevented from rotating by engagement with said immobile projections.

12. A wellhead tubing rotator, comprising:

a generally cylindrical, hollow housing having an annular main wall having a first external flange, and defining at one end an interior shoulder, and defining at the other end threads, said housing containing therewithin:

a bearing supported within said housing and above said interior shoulder, a bottom plate defining a first central opening therein, said bottom plate disposed within said housing and below said bearing, a top plate disposed within said housing and above said bearing, defining therein a second central opening, and a cap having threads cooperating with said housing threads and defining therein a third central opening, whereby said cap is installed in said housing by threading thereto;

there further being a central tubing section having a second external flange, said central tubing section rotatably supported at said second external flange by said bearing, said central tubing section passing through said first, second, and third central openings, said bottom plate supporting said bearing and partially surrounding said central tubing member, and said top plate having a second central opening therein and partially surrounding said central tubing member; and a handle attachable to said central tubing section, whereby a person can grasp said handle and rotate said central tubing section.

13. The wellhead tubing rotator according to claim 12, there further being resilient seal means disposed beneath said cap, said resilient seal means defining a fourth central opening therein, said central tubing member passing therethrough, said resilient seal means distending under compression when said cap is turned into said housing, thereby contacting said housing at selectively variable pressure, a washer disposed between said resilient seal means and said cap, said washer defining a fifth central opening therein, said central tubing member passing therethrough, said washer protecting said resilient seal means from abrasion by rotation of said cap, and a spacer disposed between said top plate and said bottom plate, said spacer defining a sixth central opening therein, said central tubing member passing therethrough and opposing compressive force from acting on said bearing when said cap is threaded into said housing.

14. The wellhead tubing rotator according to claim 12, said central tubing member extending through and beyond said housing at both ends of said housing.

15. The wellhead tubing rotator according to claim 12, said handle comprising complementary parts assembled around and clamping said central tubing section, and said cap further comprising a plurality of immobile projections extending upwardly therefrom, and said handle including member engageable with said immobile projections, whereby said wellhead tubing rotator can be prevented from rotating by engagement with said immobile projections.

16. A wellhead tubing rotator, comprising:

a generally cylindrical, hollow housing having an annular main wall having a first external flange, and defining at one end an interior shoulder, and defining at the other end threads, said housing containing therewithin:

a bearing supported within said housing and above said interior shoulder, a bottom plate defining a first central opening therein, said bottom plate disposed within said housing and below and supporting said bearing, a top plate disposed within said housing and above said bearing and defining therein a second central opening, and a cap having threads cooperating with said housing threads, said cap defining therein a third central opening, whereby said cap is installed in said housing by threading thereto above said top plate, resilient seal means disposed beneath said cap, said resilient seal means defining therein a fourth central opening and distending under compression when said cap is turned into said housing, thereby contacting said housing at selectively variable pressure, a washer disposed between said resilient seal means and said cap, said washer defining therein a fifth central opening and protecting said resilient seal means from abrasion by rotation of said cap, and a spacer disposed between said top plate and said bottom plate, said spacer defining therein a sixth central opening and opposing compressive force from acting on said bearing when said cap is threaded into said housing;

there further being a central tubing section having a second external flange, said central tubing section rotatably supported at said second external flange by said bearing, said central tubing section passing through said first, second, third, fourth, fifth, and sixth central openings and extending beyond said housing above and below; and a handle attachable to said central tubing section, whereby one person can grasp said handle and rotate said central tubing section, said cap further comprising a plurality of immobile projections extending upwardly therefrom, and said handle including member engageable with said immobile projections, whereby said wellhead tubing rotator can be prevented from rotating by engagement with said immobile projections.

* * * * *